US010226822B2

(12) United States Patent
Kim et al.

(10) Patent No.: US 10,226,822 B2
(45) Date of Patent: Mar. 12, 2019

(54) METHOD FOR PREPARING METAL NANOPARTICLES USING A MULTI-FUNCTIONAL POLYMER AND A REDUCING AGENT

(71) Applicant: UNIVERSITY-INDUSTRY COOPERATION GROUP OF KYUNG HEE UNIVERSITY, Gyeonggi-do (KR)

(72) Inventors: Woo-Sik Kim, Seoul (KR); Taekyung Yu, Seoul (KR); Aasim Shahzad, Islamabad (PK); Minyoung Yi, Gyeonggi-do (KR)

(73) Assignee: UNIVERSITY-INDUSTRY COOPERATION GROUP OF KYUNG HEE UNIVERSITY, Gyeonggi-Do (KR)

( * ) Notice: Subject to any disclaimer, the term of this patent is extended or adjusted under 35 U.S.C. 154(b) by 55 days.

(21) Appl. No.: 14/859,548

(22) Filed: Sep. 21, 2015

(65) Prior Publication Data

US 2016/0121402 A1 May 5, 2016

(30) Foreign Application Priority Data

Nov. 3, 2014 (KR) ..... 10-2014-0151547

(51) Int. Cl.
*B22F 9/24* (2006.01)
*B22F 1/00* (2006.01)

(52) U.S. Cl.
CPC ..... *B22F 9/24* (2013.01); *B22F 1/0014* (2013.01); *B22F 1/0018* (2013.01); (Continued)

(58) Field of Classification Search
None
See application file for complete search history.

(56) References Cited

U.S. PATENT DOCUMENTS 7,824,467 B2 * 11/2010 Mirkin ..... B22F 1/0018 75/371
8,088,437 B2 * 1/2012 Lee ..... B22F 1/0022 427/221

(Continued)

FOREIGN PATENT DOCUMENTS

EP 2881197 A1 * 6/2015
JP 2005-105376 4/2005

(Continued)

OTHER PUBLICATIONS

English Translation of KR 10-1423563 from Espacenet, published Aug. 1, 2014.*

*Primary Examiner* — George Wyszomierski
(74) *Attorney, Agent, or Firm* — Parker Highlander PLLC

(57) ABSTRACT

The present invention relates to a method for preparing metal nanoparticles, specifically, by reducing a precursor of metal or metal oxide in an aqueous solution, wherein polyethylenimine and an additional reducing agent are used, thereby obtaining metal nanoparticles having superior properties in improved yield.

According to the preparation method of the present invention, metal nanoparticles can be prepared at a higher concentration of metal precursor. Further, a short reaction time and the use of a solvent that is easy to handle, such as water, allow mass production of metal nanoparticles with high efficiency. Moreover, nanoparticles having a superior property can be prepared without a high-temperature treatment over 100° C.

Accordingly, the method for preparing metal nanoparticles of the present invention may innovatively simplify the preparation processes, and may also improve the working environment. Thus, it is useful for mass production of metal nanoparticles.

12 Claims, 20 Drawing Sheets

(52) U.S. Cl.
CPC ..... *B22F 2301/10* (2013.01); *B22F 2301/25* (2013.01); *B22F 2301/255* (2013.01)

(56) References Cited

U.S. PATENT DOCUMENTS

| | | | | |
|---|---|---|---|---|
| 8,802,151 | B2 * | 8/2014 | Grigorenko | B22F 1/0022 420/417 |
| 2011/0020170 | A1 * | 1/2011 | Luinstra | B22F 1/0018 420/463 |
| 2017/0213615 | A1 * | 7/2017 | Okada | B22F 9/24 |

FOREIGN PATENT DOCUMENTS

| | | |
|---|---|---|
| JP | 2009-221591 | 10/2009 |
| JP | 2013-522469 | 6/2013 |
| KR | 2009-0008345 | 1/2009 |
| KR | 2009-0043499 | 5/2009 |
| KR | 2014-0001921 | 1/2014 |
| KR | 10-1423563 | 8/2014 |

* cited by examiner

【FIG. 1a】
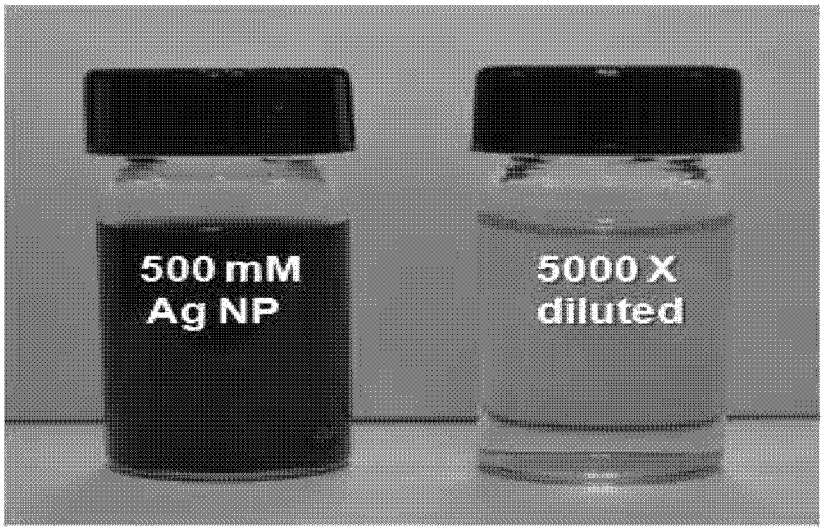
【FIG. 1b】
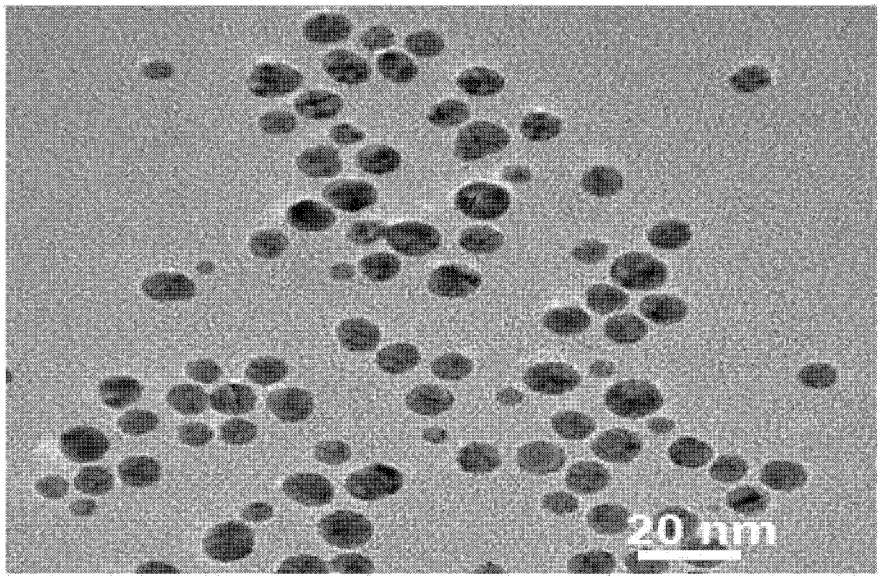

【FIG. 1c】
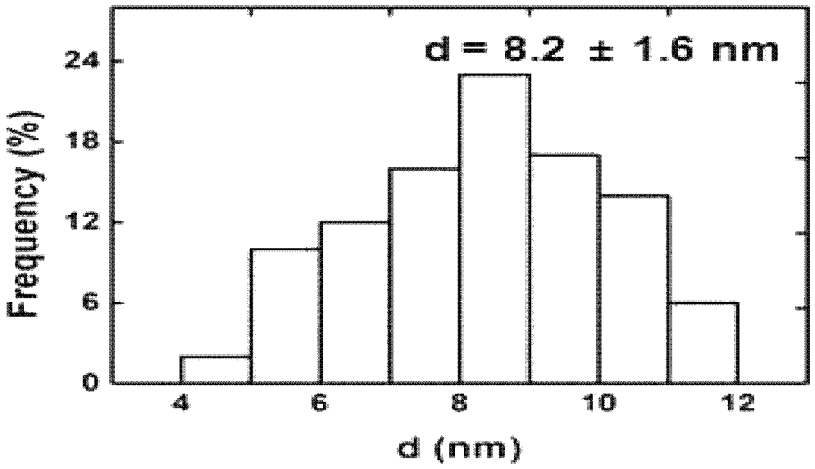
【FIG. 1d】
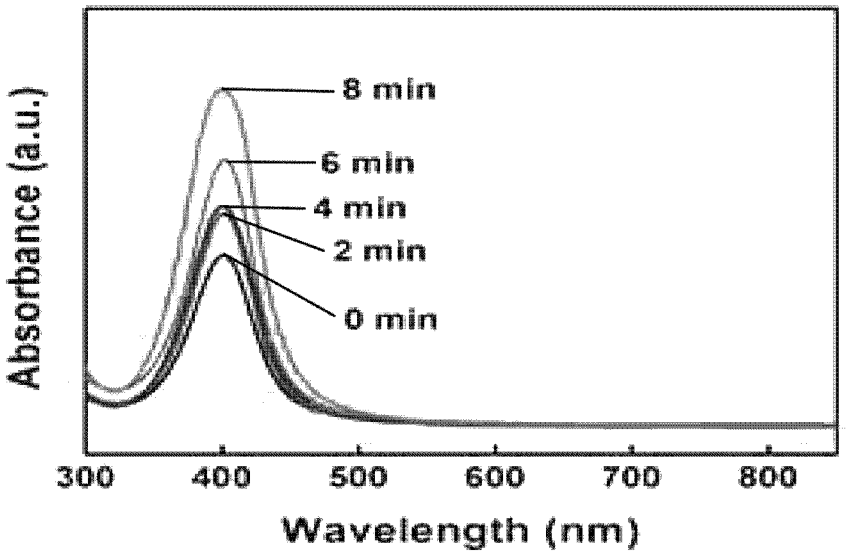

【FIG. 1e】
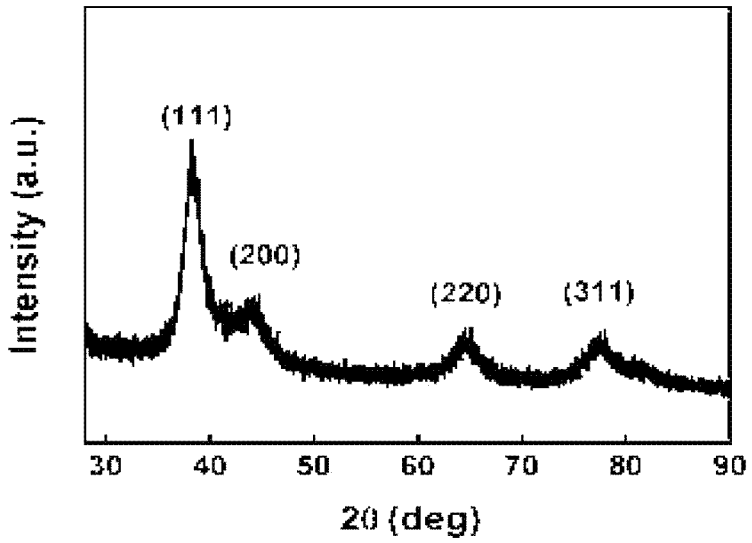
【FIG. 1f】
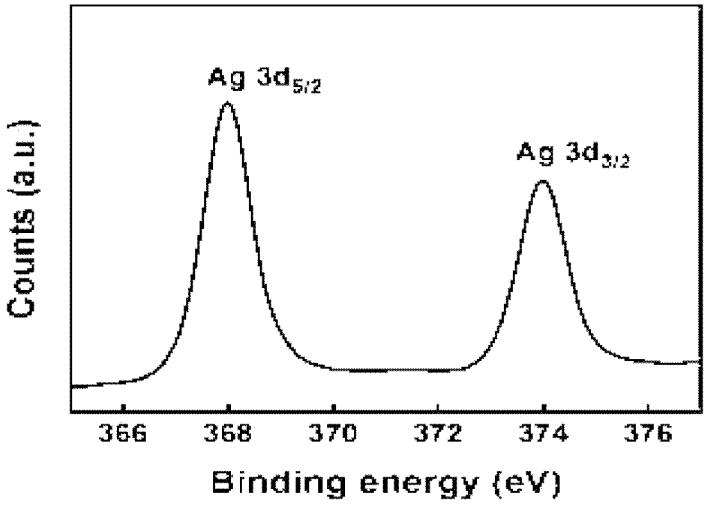

【FIGS. 2a-d】
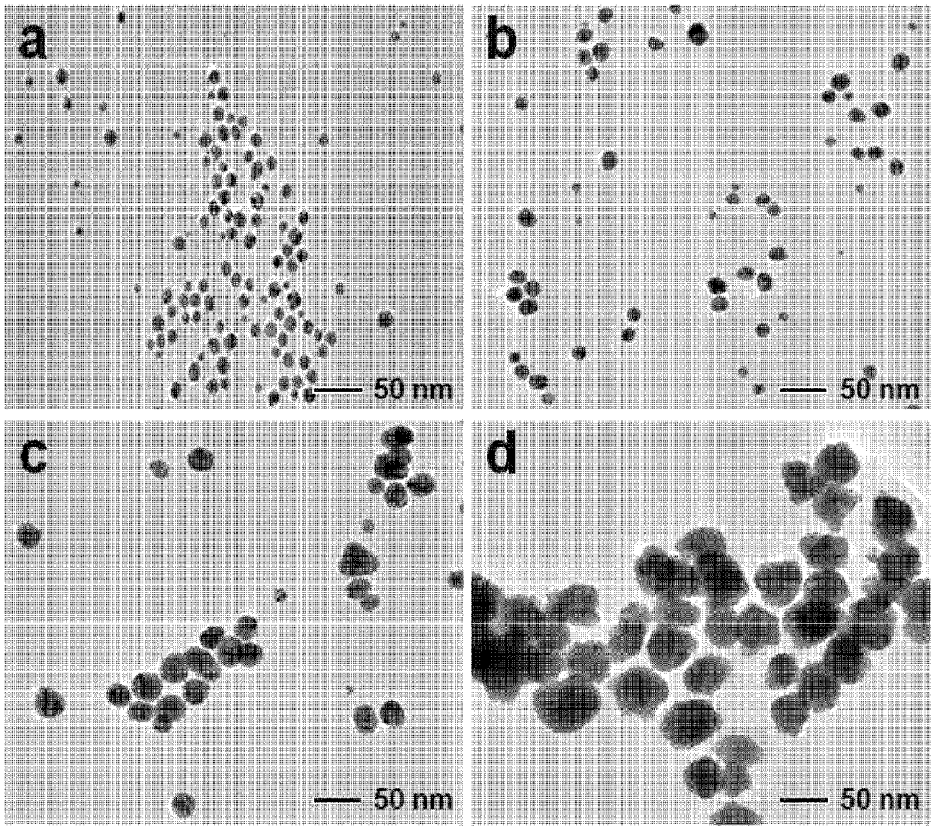

【FIGS. 3a-d】
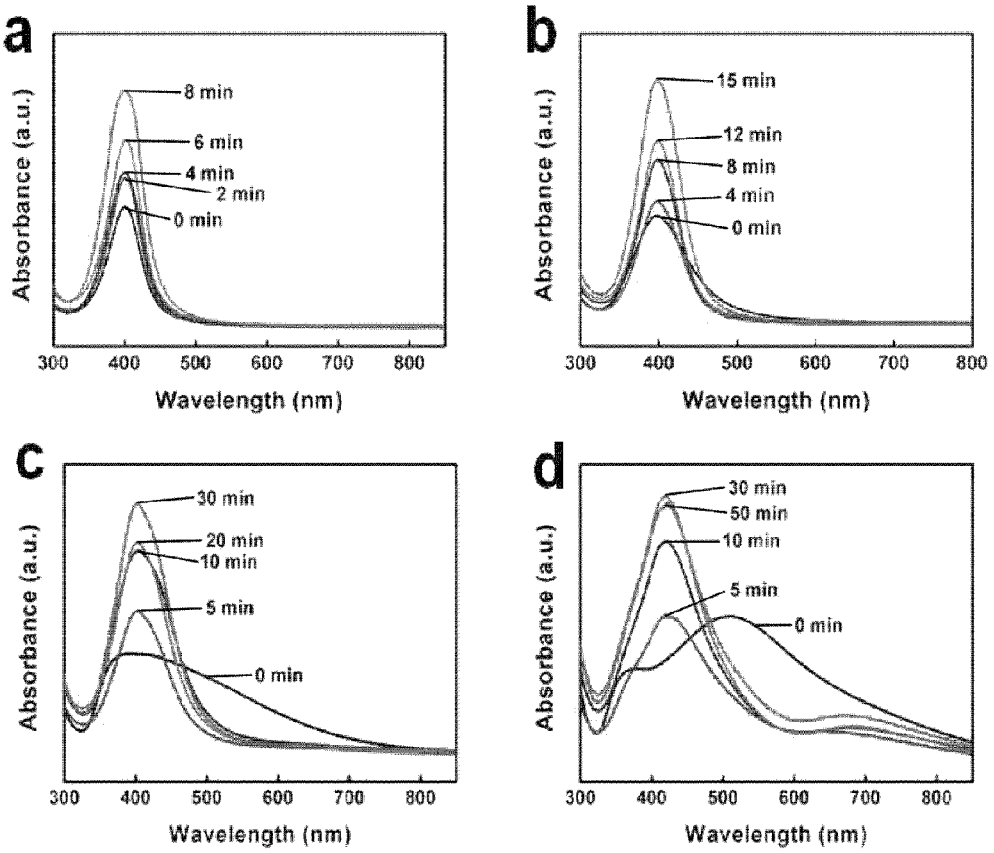

【FIGS. 4a-d】
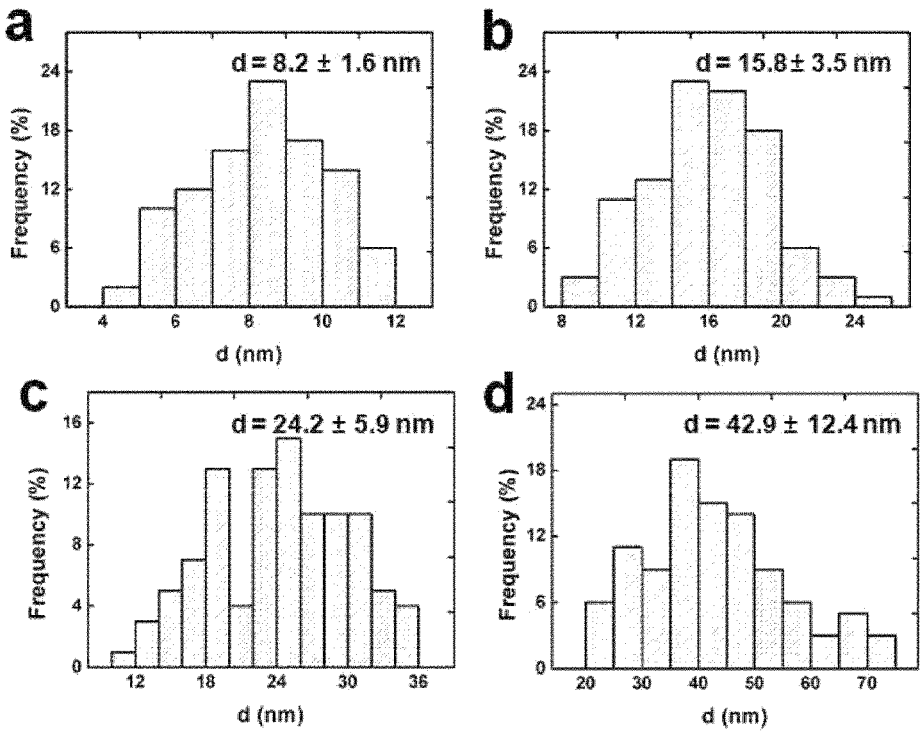

【FIGS. 5a-c】
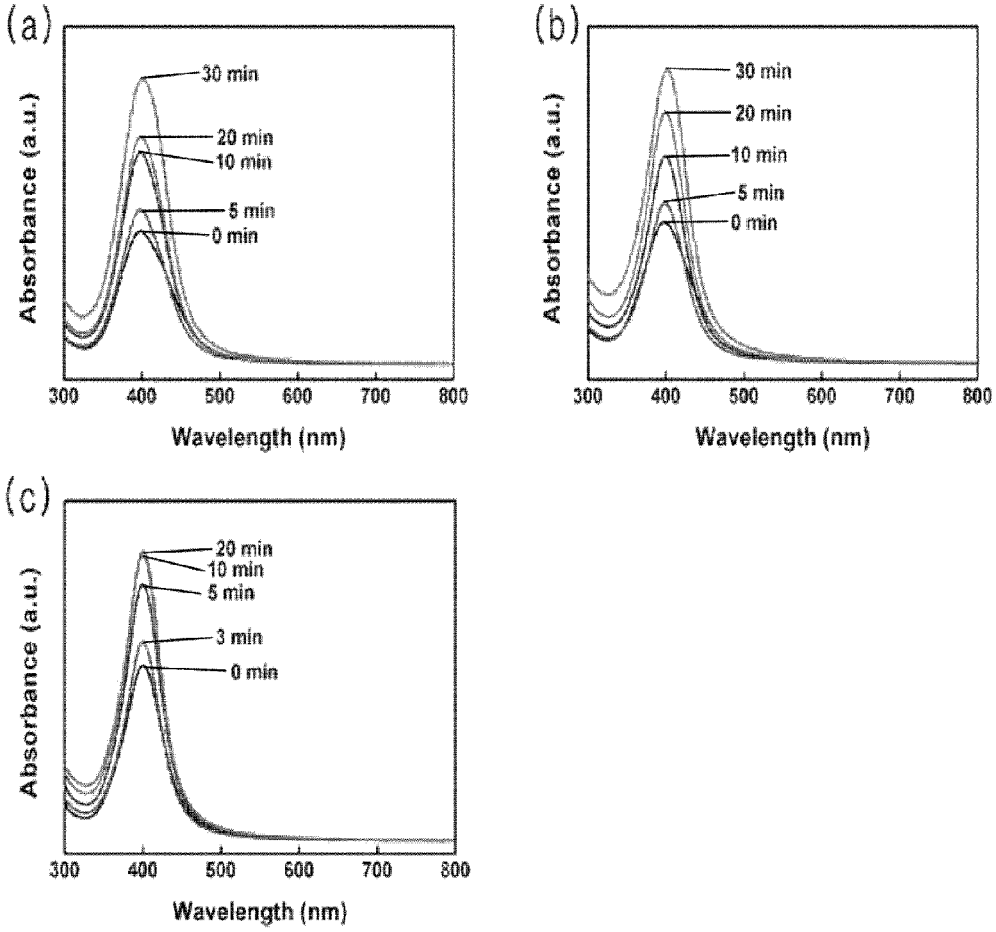

【FIGS. 6a-f】
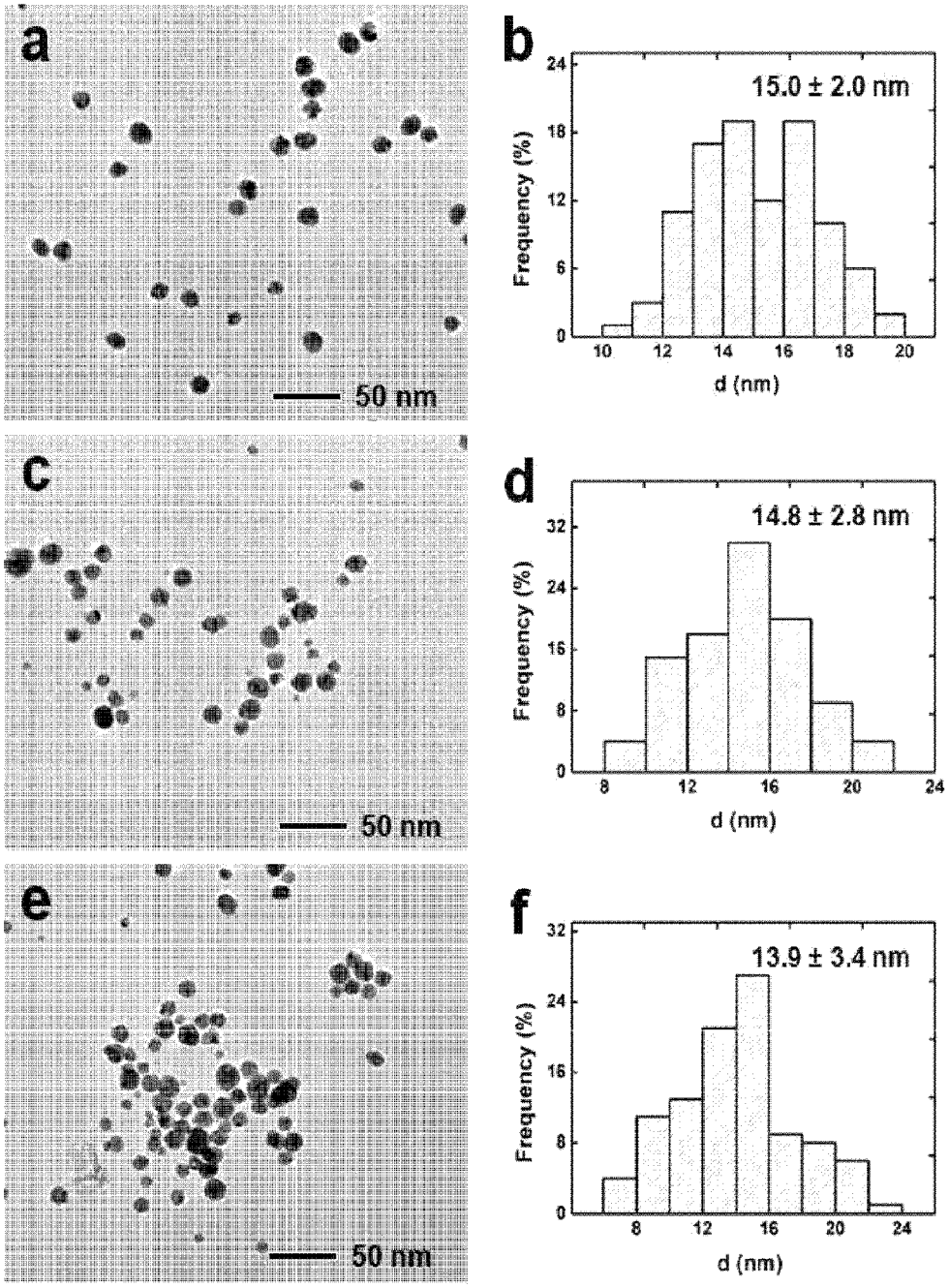

【FIG. 7】
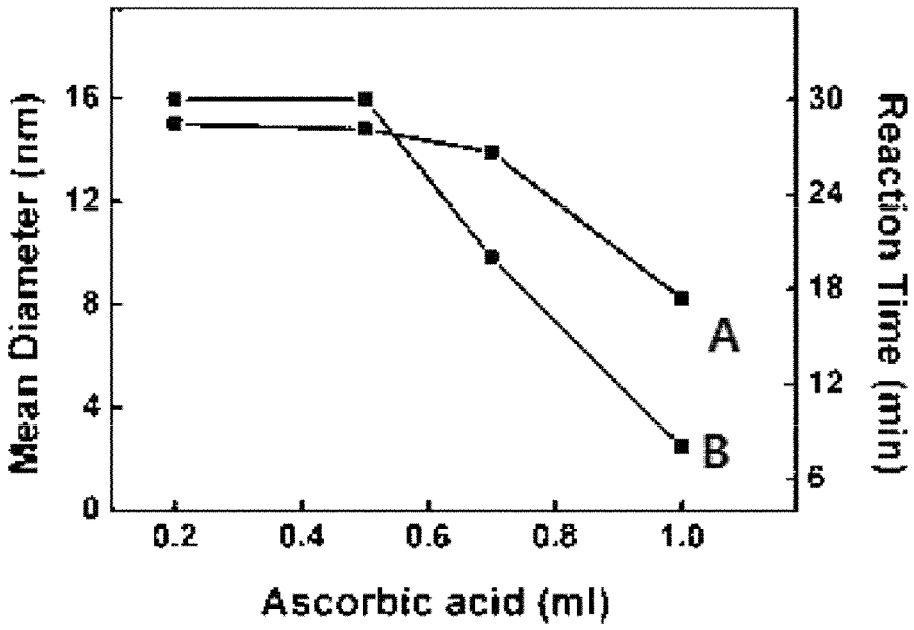

【FIGS. 8a-d】
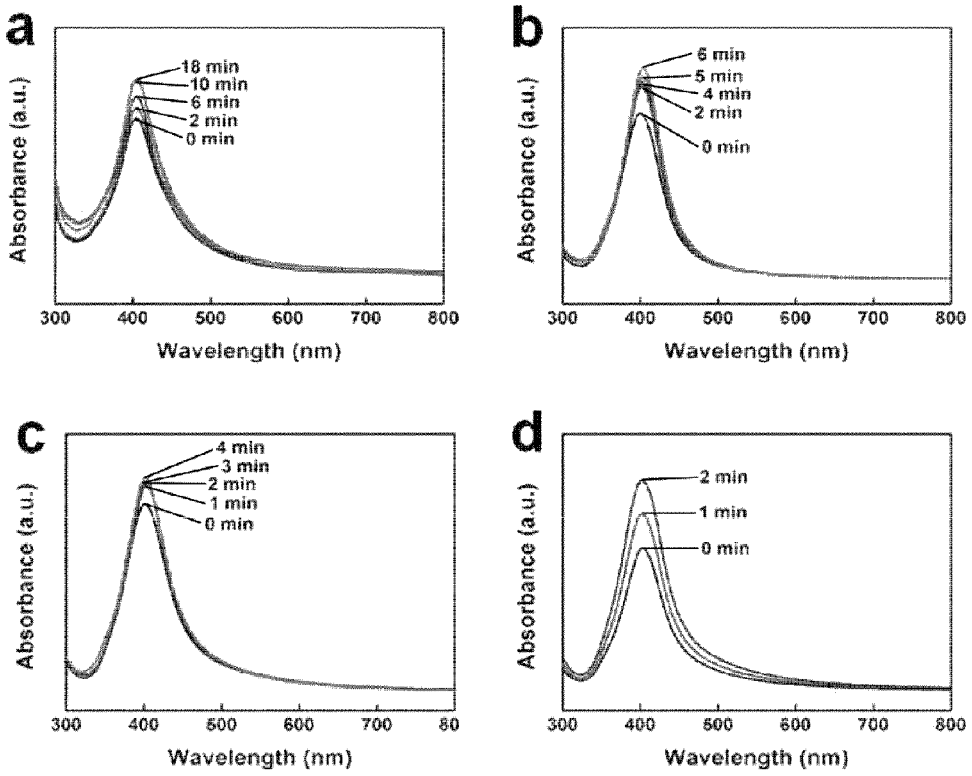

【FIGS. 9a-d】
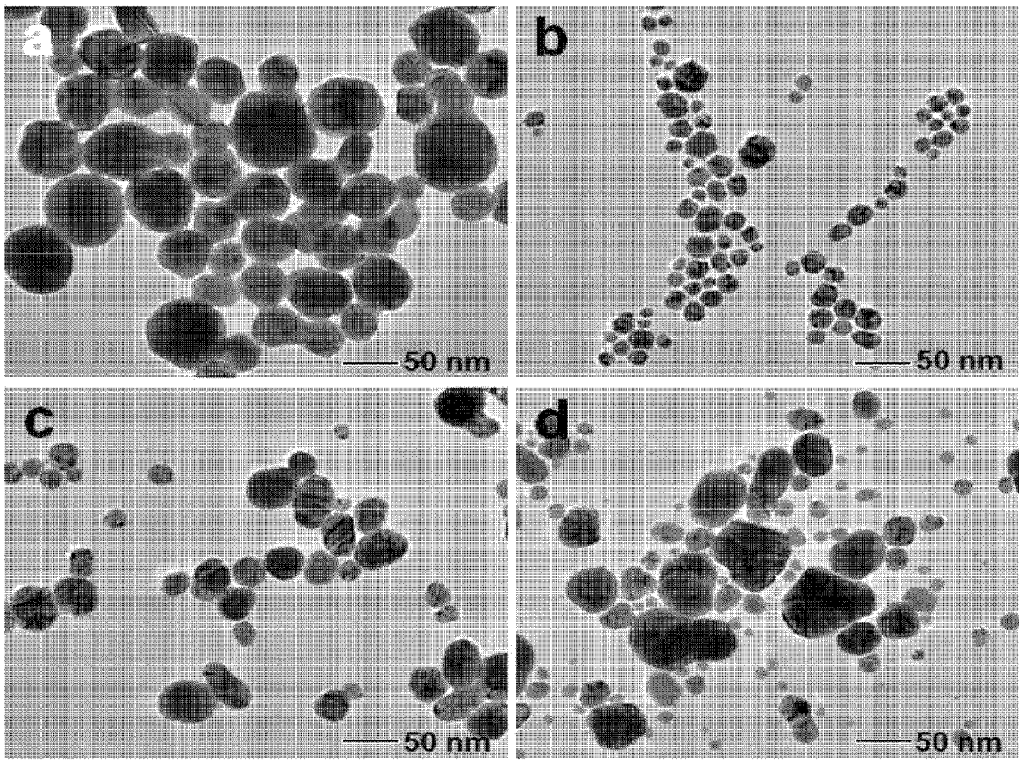

【FIGS. 10a-d】
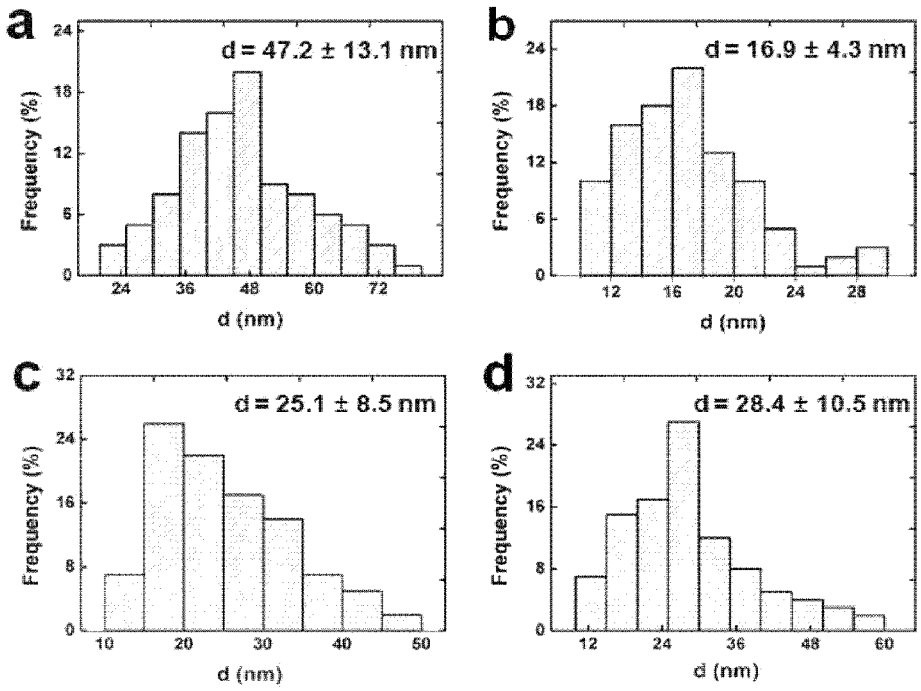

【FIGS. 11a-d】
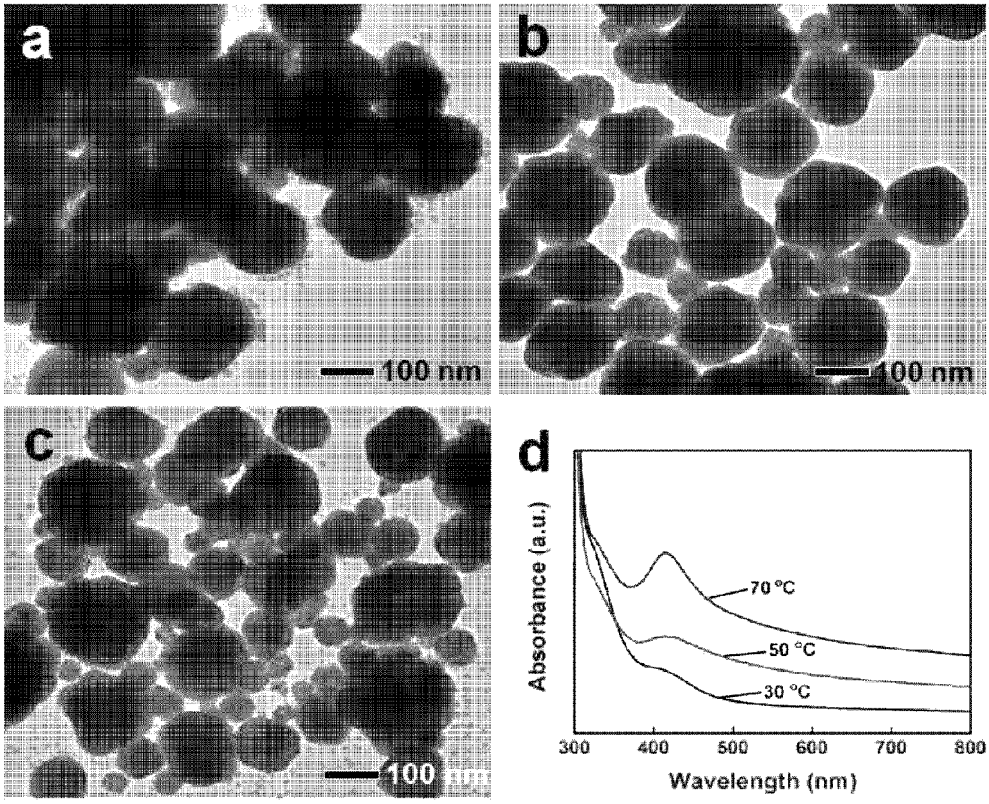

【FIGS. 12a-d】
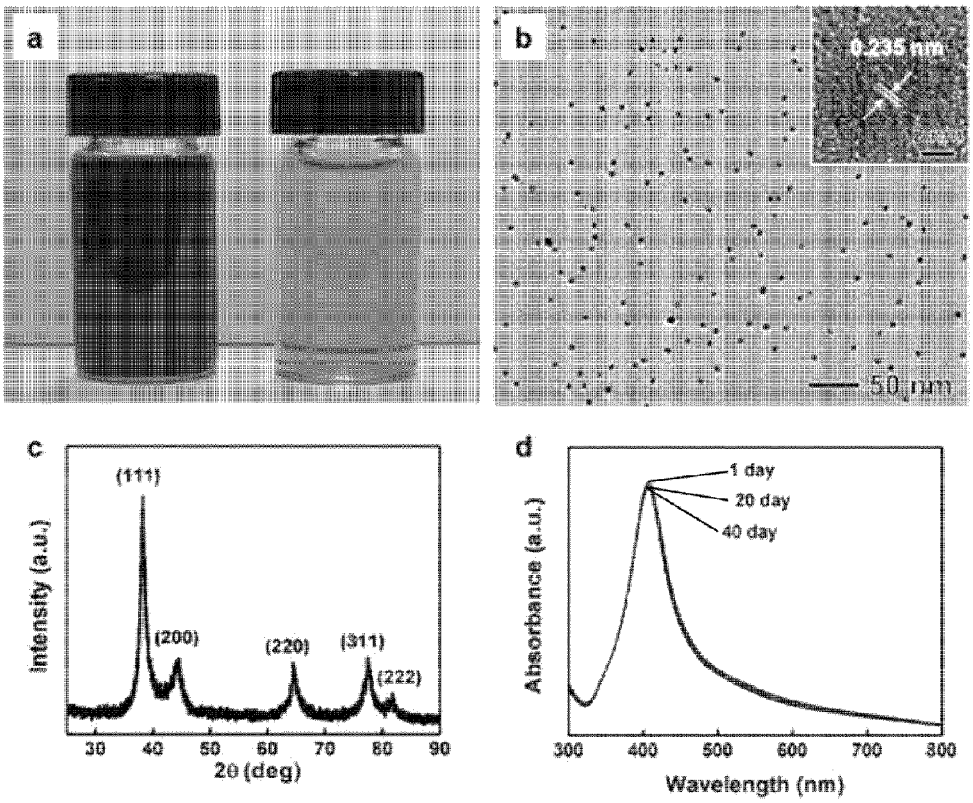

【FIG. 13】
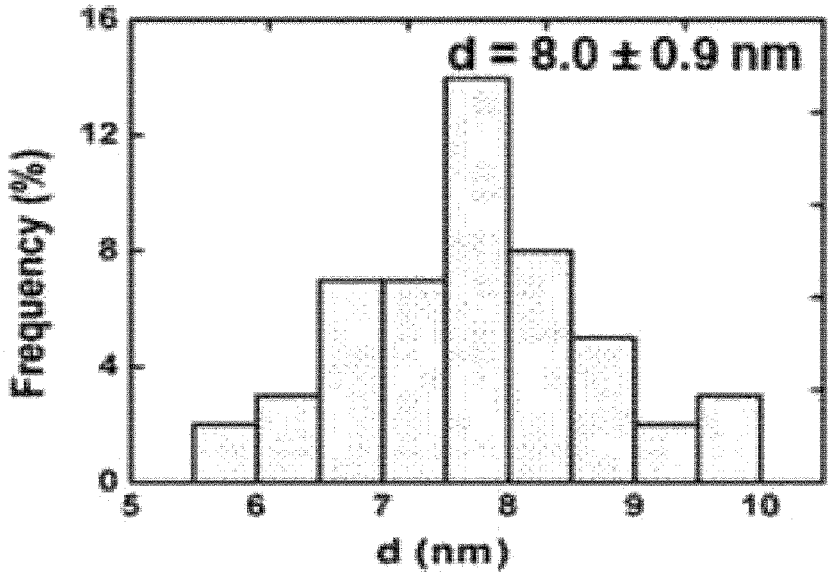

【FIG. 14】
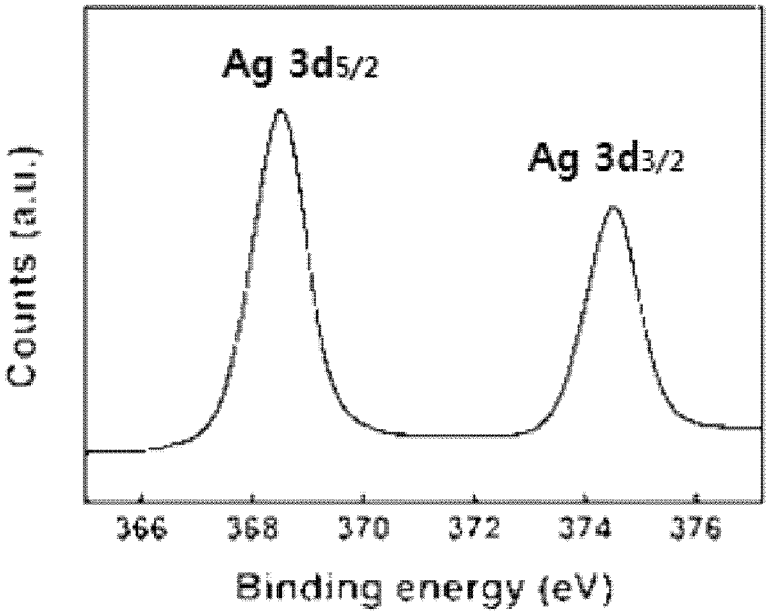

【FIGS. 15a-f】
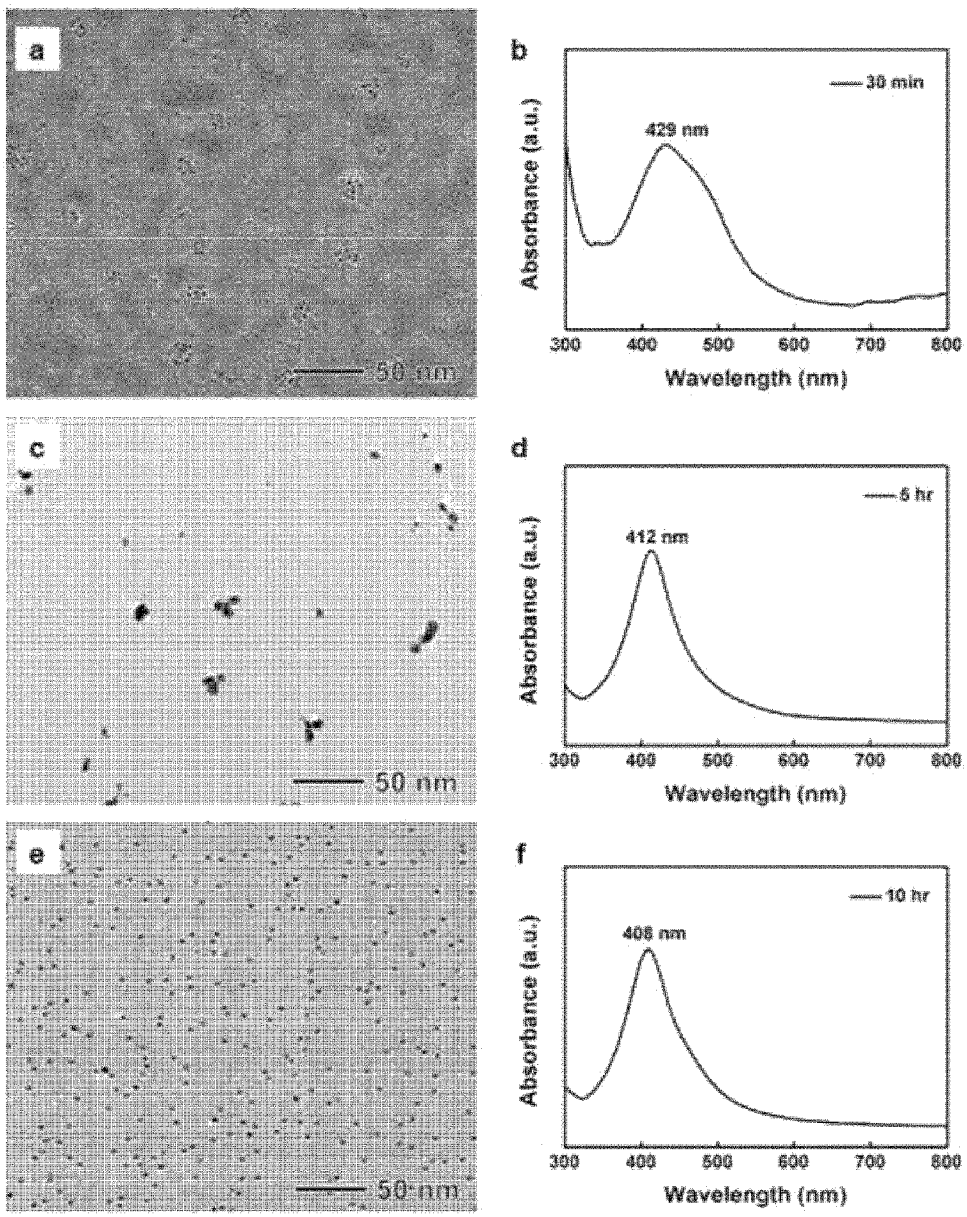

【FIG. 16】
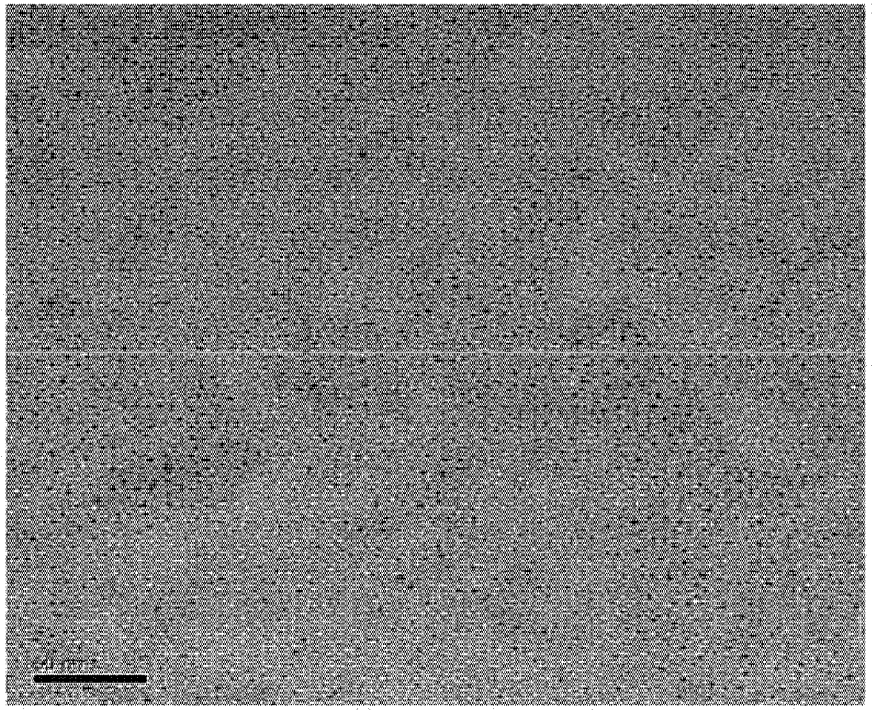

【FIG. 17】
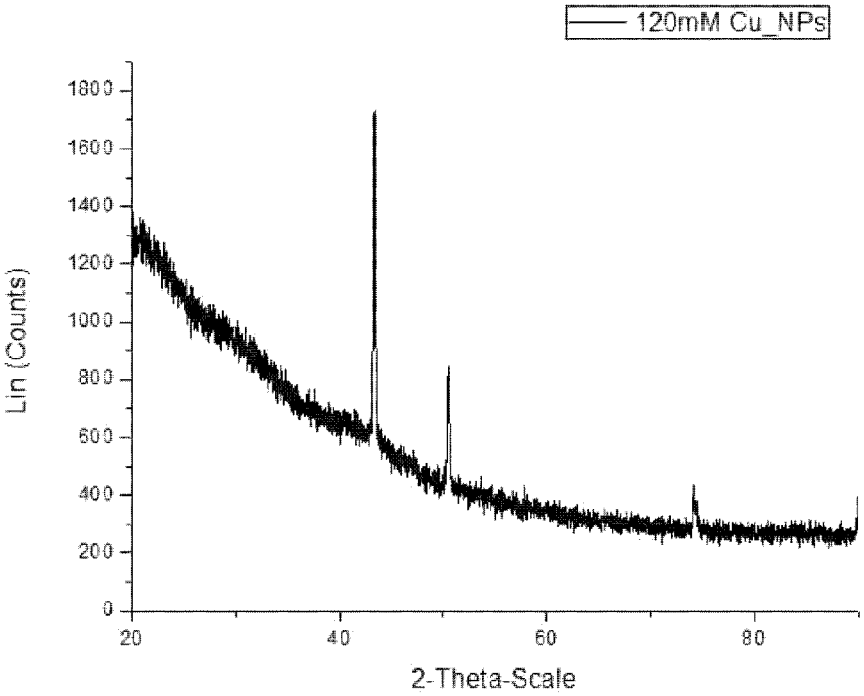

【FIG. 18】
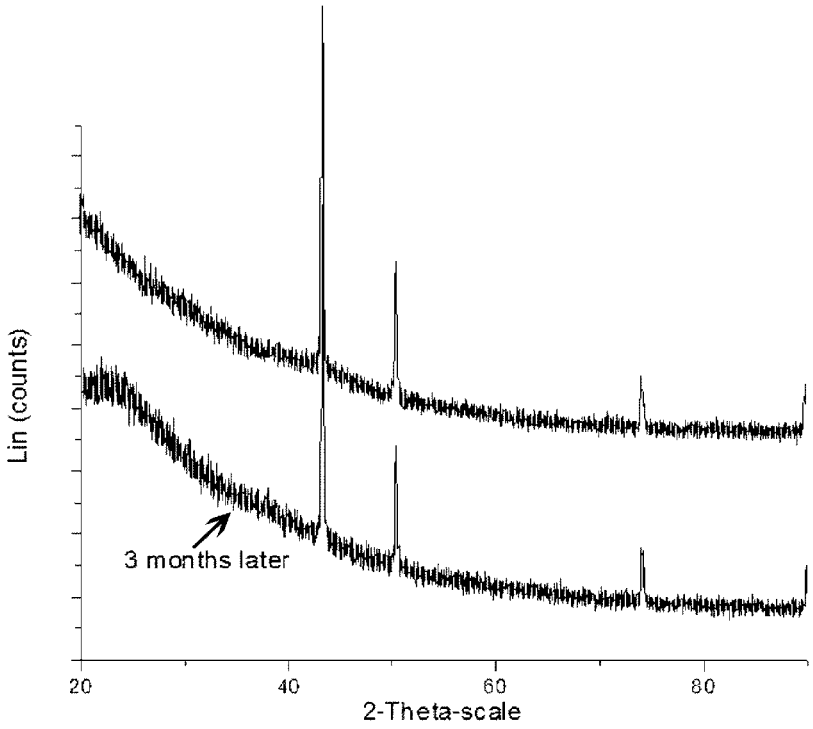

METHOD FOR PREPARING METAL NANOPARTICLES USING A MULTI-FUNCTIONAL POLYMER AND A REDUCING AGENT

BACKGROUND OF THE INVENTION

1. Field of the Invention

The present invention relates to a method for preparing metal nanoparticles, and specifically, to a method for more efficiently preparing metal nanoparticles with superior properties by reducing a metal precursor compound in an aqueous solution using polyethylenimine and additional reducing agent.

2. Description of the Prior Art

Metal nanoparticles are diversely utilized in electronics, optical sciences, catalysts, and biological fields, etc due to their physicochemical properties. Specifically, conductive metal nanoparticles can be used to prepare conducting films, and thus they are of high interest in the fields of smart windows, rewritable electronic papers, electronic panel displays, and flexible displays, etc.

These metal nanoparticles can be prepared by various methods including reduction-precipitation method in an aqueous solution, an electrochemical method, an aerosol method, a reverse microemulsion method, a chemical liquid phase deposition method, a photochemical reduction method, and a chemical reduction method in a solution, etc. However, such preparation methods are either very complicated or exhibit very low yield, and thus there has been a need for the development of an improved and novel method.

The existing method for preparing metal nanoparticles includes a seed mediated synthesis method developed by Murphy et al., one of the representative methods for preparing gold nanoparticles. In this method, $NaBH_4$, a strong reducing agent, is used to form a gold cluster with a diameter of about 3 to 4 nm, and then allows the gold cluster to grow into nanoparticles by adding a seed to a hydrogen tetrachloroaurate acid solution containing ascorbic acid, which is a weak reducing agent. This method has disadvantages in that it requires preparation of many types of chemical materials, the process is very complicated, and the number of moles of a gold particle to be prepared per unit volume is limited to 2.5 mM, thus resulting in a very low yield.

To complement such disadvantages, a one-pot synthesis method (Hoppe et al.) using polymer (a representative example includes polyvinylpyrrolidone (PVP)) may be used because the preparation process is relatively simple. However, the problem of low yield still remains unsolved due to the limitation on the concentration of a gold precursor compound to 2 mM.

Also, in the case of silver nanoparticles, when ascorbic acid is used as an organic reducing agent in a reducing method, there is a limitation in controlling particles because the ascorbic acid reduces silver ions even at room temperature, whereas when glucose is used, there is a need for a large amount of polar solvents to adjust the contrast concentration of a silver ion due to a low solubility even in water system, and thus it is difficult to perform a synthesis of high-concentration particles. For these reasons, the conventional silver particle syntheses were only possible at low concentrations (less than 0.05 M), and the amount of uniform particles to obtain from a batch was also limited.

As such, the current methods for synthesizing nanoparticles exhibit a very low production efficiency at the level of diluted concentration conditions, thereby imposing limitations on commercialization, because the nanoparticles tend to aggregate when synthesized at a high concentration. Nanoparticles having a high surface area to volume have a strong aggregative force to exhibit stability, and this force may increase as the concentration of a reactant increases. For this reason, it is difficult to perform a large-scale synthesis of nano-size particles at a high concentration.

As an alternative to solve these problems, Korea Patent No. 10-1423563 discloses a method for producing metal nanoparticles with a high concentration using polyethylenimine (PET) as a reducing agent and a stabilizer. However, the concentration of Ag nanoparticles prepared by the method is 200 mM (i.e., about 20 g/L), which is still insufficient to carry out a large-scale production of metal nanoparticles, and the reaction requires relatively long hours of from 2 to 10 hours, thereby still imposing problems of low production efficiency. Further, the method could not prepare Cu nanoparticles due to weak reducing power of polyethylenimine.

The present inventors have made extensive efforts to resolve such problems of the conventional technologies, and as a result, they could prepare Ag nanoparticles with a high concentration of 500 mM (i.e., about 50 g/L), when polyethylenimine is used together with additional reducing agent, thereby enabling the preparation of metal nanoparticles with high efficiency due to a short reaction time, and subsequently, enabling the preparation of Cu nanoparticles with a concentration higher than 100 mM, which were difficult to prepare by the conventional methods, thus confirming that it is suitable for large-scale production of metal nanoparticles as water can be used as a solvent facilitating large scale processes. Further, it was confirmed that, depending on process conditions, the size of nanoparticles can be easily controlled, and the crystal structures of the nanoparticles can be stably maintained without changes during a long-term storage, thus completing the present invention.

SUMMARY OF THE INVENTION

One objective of the present invention is to provide a method for preparing nanoparticles by reacting a metal precursor with polyethylenimine and a reducing agent in an aqueous solution.

DETAILED DESCRIPTION OF INVENTION

In one aspect for achieving the objective described above, the present invention provides a method for preparing nanoparticles by reacting a metal precursor with polyethylenimine and a reducing agent in an aqueous solution.

Hereinafter, the method for preparing nanoparticles of the present invention will be described in detail.

The method for preparing nanoparticles of the present invention is useful in preparing nanoparticles of metals such as gold (Au), silver (Ag), copper (Cu), palladium (Pd), platinum (Pt), ruthenium (Ru) or rhodium (Rd), etc due to the property of an amine functional group bound to polyethylenimine and the reducing power of a reducing agent.

A metal precursor of the present invention may be selected from various types of compounds depending on the type of a metal nanoparticle to be prepared. For example, the metal precursor suitable for preparing silver nanoparticles is at least one selected from $AgBF_4$, $AgCF_3SO_3$, $AgClO_4$, $AgNO_3$, $Ag(CH_3COO)$, $AgPF_6$, $Ag(CF_3COO)$, or a combination thereof. Specifically, when preparing silver nanoparticles, it may be preferable to use $AgNO_3$ as a silver precursor.

Further, the metal precursor suitable for preparing copper nanoparticles is at least one selected from $CuCl_2$, $CuF_2$, $CuBr_2$, $CuI_2$, $(CH_3COO)_2Cu$, $Cu(ClO_4)_2$, $Cu(NO_3)_2$, $CuSO_4$, or a combination thereof. Specifically, when preparing copper nanoparticles, it may be preferable to use $CuCl_2$ as a copper precursor.

Furthermore, the metal precursor for preparing gold nanoparticles is at least one selected from $HAuCl_4$, $NaAuCl_3$, $AuCl_3$, or a combination thereof. Specifically, when preparing gold nanoparticles, it may be preferable to use $HAuCl_4$ as a gold precursor.

The metal precursor for preparing palladium nanoparticles is at least one selected from $Pd(OAc)_2$, $Pd(acac)_2$, $PdI_2$, $Pd(NO_2)_2$, $Pd(CF_3COO)_2$, $Pd(CN)_2$, $Na_2PdCl_4$, $PdCl_2$, $PdBr_2$, $PdF_2$, or a combination thereof. Specifically, when preparing palladium nanoparticles, it may be preferable to use $Na_2PdCl_4$ as a palladium precursor.

Further, the metal precursor for preparing platinum nanoparticles is at least one selected from $K_2PtCl_2$, $H_2PtCl_4$, $K_2PtCl_6$, $H_2PtCl_6$, $Pt(NH_3)_4Cl_2$, $Pt(C_5H_5N)_4Cl_2$, $Pt(CH_3NH_2)_4Cl_2$, $Pt(C_4H_9NH_2)_4Cl_2$, or a combination thereof. Specifically, when preparing platinum nanoparticles, it may be preferable to use $K_2PtCl_2$ as a platinum precursor.

Further, the metal precursor for preparing ruthenium nanoparticles is at least one selected from $[Ru(benzene)Cl_2]_2$, $RuCl_3$, $Ru(ac)_3$, or a combination thereof. Specifically, when preparing ruthenium nanoparticles, it may be preferable to use $RuCl_3$ as a ruthenium precursor.

Furthermore, the metal precursor for preparing rhodium nanoparticles is at least one selected from $RhCl_3(H_2O)_3$, $Rh(acac)_3$, or a combination thereof. Specifically, when preparing rhodium nanoparticles, it may be preferable to use $RhCl_3(H_2O)_3$ as a rhodium precursor.

Polyethylenimines that can be used in the present invention is largely divided into a branched one and a linear one based on their structures. A branched polyethylenimine (BPEI) may be represented by Formula 1 below, and a linear polyethylenimine (LPEI) may be represented by Formula 2 below. According to the present invention, both BPEI and LPEI may be used, however, LPEI may cause an aggregation and produce nanoparticles of various sizes and shapes, whereas BPEI may produce nanoparticles of a uniform size without aggregation.

[Formula 1]

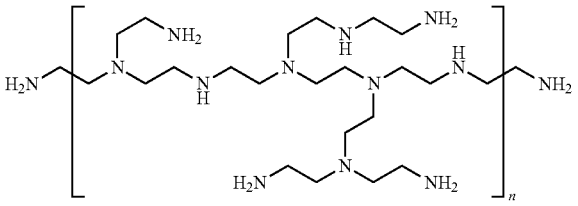

BPEI

[Formula 2]

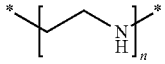

LPEI

The polyethylenimine that can be used in the method for preparing nanoparticles of the present invention may be any PEI regardless of a molecular weight (a degree of polymerization), preferably, PEI having a molecular weight from 20,000 to 1,000,000, and more preferably, from 200,000 to 750,000 may be used.

A reducing agent suitable for the preparation of nanoparticles of the present invention is at least one selected from the group consisting of ascorbic acid, sodium hydroxide (NaOH), potassium hydroxide (KOH), hydrazine ($N_2H_4$), sodium hydrophosphate, glucose, tannic acid, dimethylformamide, tetrabutylammonium borohydride, sodium borohydride ($NaBH_4$), lithium borohydride ($LiBH_4$). Preferably, it may be ascorbic acid.

Aggregation phenomena, size uniformity, and the production efficiency of the nanoparticles may vary depending on a weight ratio of polyethylenimine to metal precursor in the method for preparing nanoparticles of the present invention. The reducing power and the capping ability of polyethylenimine for the amount of a metal precursor should be sufficiently provided in order to readily produce nanoparticles. According to the present invention, the weight ratio of polyethylenimine to metal precursor in a reaction solution is from 1:1 to 20:1, preferably, from 2:1 to 15:1. When the polyethylenimine content is relatively smaller relative to the above ratio, a few number of nuclei may be produced due to a weak reducing power of polyethylenimine, and may not control the growth of the particles due to insufficient capping ability, thereby causing an intermolecular aggregation. In contrast, when the polyethylenimine content is relatively larger relative to the above ratio, the metal precursor and polyethylenimine may form a stable metal-polyethylenimine polymer, thereby increasing the reaction time, decreasing the production efficiency because it is difficult to control the size of nanoparticles, and as a result, it may not be easy to remove the nanoparticles during washing.

In an embodiment of the present invention, during the preparation of silver nanoparticles, although the weight ratio of BPEI:$AgNO_3$ increased as the reaction time increased, the Ag nanoparticles were obtained for up to 50 minutes. Further, when the ratio was 2:1, the required reaction time was about 8 minutes, which enabled to obtain the nanoparticles in the shortest time (Examples 1 and 2, FIGS. 3*a-d*). Accordingly, Ag nanoparticles of various sizes with a high concentration of 500 mM were obtained for up to 50 minutes by controlling the weight ratio of BPEI:$AgNO_3$ (Examples 1 and 2).

In the method for preparing nanoparticles of the present invention, a reaction temperature may also have an effect on the nanoparticle preparation. When the reaction temperature is low, the size of nanoparticles prepared may not be uniform, thereby decreasing the production efficiency. In contrast, as the reaction temperature increases, the size of nanoparticles generally decreases, becoming uniform, thereby increasing the reaction rate. However, once the temperature exceeds a certain temperature, there is no noticeable improvement. Considering these facts, preferably, the reaction is performed from 70° C. to 100° C., more preferably, from 70° C. to 90° C.

In an exemplary embodiment of the present invention, Ag nanoparticles of uniform sizes with a high concentration of 500 mM were prepared by reacting Ag nanoparticles with BPEI, silver nitrate, and ascorbic acid at 90° C. for up to 10 minutes (Example 5), and copper nanoparticles of uniform sizes with a high concentration of 120 mM were prepared by reacting copper nanoparticles with BPEI, silver nitrate, and ascorbic acid at 80° C. for up to 3 hours (Example 6).

In the method for preparing nanoparticles of the present invention, the amount of reducing agent may have an effect on the nanoparticle preparation. Preferably, the concentration of the reducing agent to be used may be from 0.5 M to 1.5 M. Considering the control of preferred particle size and the reaction efficiency, the amount of reducing agent may be appropriately selected within the concentration range. When the amount of reducing agent used is lower than the concentration range, the reaction time increases significantly and a complete reduction reaction may not occur, thereby decreasing the efficiency. In contrast, when the amount of reducing agent used is higher than the concentration range, although the reaction time may be shortened, it is difficult to obtain nanoparticles of uniform sizes.

In an exemplary embodiment of the present invention, in the preparation of silver nanoparticles, when the volumes of 1M ascorbic acid used were 0.2 ml and 0.5 ml the reactions were completed in 30 minutes, whereas, when the volume was 0.7 ml, the reaction was completed in 20 minutes (Example 3, FIGS. 5*a-c*). However, when 1.0 ml of ascorbic acid was used, the reaction time was 8 minutes, obtaining the Ag nanoparticles in the shortest time (Example 1, FIG. 1*d*, and B line of FIG. 7).

In the method for preparing nanoparticles of the present invention, the amount of the metal precursor may have an effect on the nanoparticle preparation. The metal precursor may be used at a concentration from 0.01 M to 1.5 M, preferably from 0.01 M to 1 M. Considering the control of preferred particle size and the reaction efficiency, the amount of metal precursor may be appropriately selected within the above concentration range. When the concentration of the metal precursor is lower than 0.01 M, the production efficiency is low, and it may be difficult to control the particle size. In contrast, when the concentration of the metal precursor exceeds 1.5 M, although the reaction time may be shortened, it may be difficult to control the particle size due to an aggregation of particles, and the reagent may be wasted due to excessive use of the metal precursor.

In an exemplary embodiment of the present invention, Ag nanoparticles of uniform sizes with a concentration of 500 mM were prepared using $AgNO_3$ concentrations of 0.2 M, 0.5 M, 0.7 M, 0.8 M, and 1.0 M, respectively, during the preparation of Ag nanoparticles (Examples 1 and 4).

In an exemplary embodiment of the present invention, a reaction for preparing metal nanoparticles may be performed by adding an aqueous solution of silver nitrate as a metal precursor to an aqueous solution of a branched polyethylenimine, stirring the resulting reaction solution, and then adding an aqueous solution of ascorbic acid as a reducing agent to the reaction solution. Further, the reaction may be performed at a temperature from 70° C. to 100° C. for from 2 minutes to 1 hour.

In another exemplary embodiment of the present invention, a reaction for preparing metal nanoparticles may be performed by adding an aqueous solution of copper (II) chloride as a metal precursor to an aqueous solution of a branched polyethylenimine, stirring the resulting reaction solution, and then adding an aqueous solution of ascorbic acid as a reducing agent to the reaction solution. Further, the reaction may be performed at a temperature from 70° C. to 100° C. for 1 to 4 hours.

Effect of the Invention

According to the preparation method of the present invention, metal nanoparticles can be prepared at a higher concentration of metal precursor. Further, a short reaction time and the use of a solvent that is easy to handle, such as water, allow mass production of metal nanoparticles with high efficiency. Moreover, nanoparticles having a superior property can be prepared without a high-temperature treatment over 100° C.

Specifically, the method of the present invention produces Ag nanoparticles with a high concentration of 500 mM (i.e., about 50 g/L), and due to a short reaction time from at least less than 10 minutes, at most up to 1 hour, metal nanoparticles with high efficiency can also be prepared. Also, the method of the present invention enables the preparation of copper nanoparticles with a concentration higher than 100 mM, which were difficult to prepare using conventional methods. In addition, the particle size can be readily controlled depending on the process conditions, providing stable nanoparticles without altering crystal structures thereof even under a long-term storage.

BRIEF DESCRIPTION OF THE DRAWINGS

FIG. 1*a* shows a picture of vials containing 0.5 M Ag nanoparticles and a 5000-fold diluted nanoparticle suspension thereof, FIG. 1*b* shows a TEM image of Ag nanoparticles synthesized by Ag-PEI-AA (ascorbic acid), FIG. 1*c* shows an average particle size distribution of Ag nanoparticles, FIG. 1*d* shows a UV-vis spectrum of Ag nanoparticles, FIG. 1*e* shows a XRD pattern of Ag nanoparticles, and FIG. 1*f* shows an XPS spectrum of Ag nanoparticles.

FIGS. 2*a-d* show TEM images of Ag nanoparticles prepared at 90° C. under $AgNO_3$ initial concentration of 0.5 M and 1 M ascorbic acid with the ratio of BPEI/$AgNO_3$ (wt/wt) equals to a) 2, b) 5, c) 7, and d) 11, respectively.

FIGS. 3*a-d* show UV-vis spectrums of Ag nanoparticles prepared at 90° C. under $AgNO_3$ initial concentration of 0.5 M and 1 M ascorbic acid with the ratio of BPEI/$AgNO_3$ (wt/wt) equals to a) 2, b) 5, c) 7, and d) 11, respectively.

FIGS. 4*a-d* show average particle size distributions of Ag nanoparticles prepared at 90° C. under $AgNO_3$ initial concentration of 0.5 M and 1 M ascorbic acid with the ratio of BPEI/$AgNO_3$ (wt/wt) equals to a) 2, b) 5, c) 7, and d) 11, respectively.

FIGS. 5*a-c* show UV-vis spectrums of Ag nanoparticles prepared at 90° C. under $AgNO_3$ initial concentration of 0.5 M with the ratio of BPEI/$AgNO_3$ (wt/wt) equals to 2 by adding a) 0.2 ml, b) 0.5 ml, and c) 0.7 ml of 1 M ascorbic acid, respectively.

FIGS. 6*a-f* show TEM images and average particle size distributions of Ag nanoparticles prepared at 90° C. under $AgNO_3$ initial concentration of 0.5 M with the ratio of BPEI/$AgNO_3$ (wt/wt) equals to 2 by adding a) b) 0.2 ml, c) d) 0.5 ml, and e) f) 0.7 ml of 1 M ascorbic acid, respectively.

FIG. 7 shows the average particle size (nm) (A line) and the reaction time (B line) of Ag nanoparticles prepared at 90° C. under $AgNO_3$ initial concentration of 0.5 M with the ratio of BPEI/$AgNO_3$ (wt/wt) equals to 2 by adding various amounts of 1M ascorbic acid.

FIGS. 8*a-d* show UV-vis spectrum of Ag nanoparticles prepared at 90° C. under 1 ml of 1M ascorbic acid with the ratio of BPEI/$AgNO_3$ (wt/wt) equals to 2 by adding $AgNO_3$ concentrations of a) 0.2 M, b) 0.7 M, c) 0.8 M, and d) 1.0 M, respectively.

FIGS. 9*a-d* show TEM images of Ag nanoparticles prepared at 90° C. under 1 ml of 1 M ascorbic acid with the ratio of BPEI/$AgNO_3$ (wt/wt) equals to 2 by adding $AgNO_3$ concentrations of a) 0.2 M, b) 0.7 M, c) 0.8 M, and d) 1.0 M, respectively.

FIGS. 10*a-d* show the average particle size distribution of Ag nanoparticles prepared at 90° C. under 1 ml of 1 M ascorbic acid with the ratio of BPEI/$AgNO_3$ (wt/wt) equals to 2 by adding $AgNO_3$ concentrations of a) 0.2 M, b) 0.7 M, c) 0.8 M, and d) 1.0 M, respectively.

FIGS. 11*a-d* show TEM images and UV-vis spectrums of Ag nanoparticles (0.5 M) prepared under $AgNO_3$ initial concentration of 0.5 M and 1 ml of 1 M ascorbic acid with the ratio of BPEI/$AgNO_3$ (wt/wt) equals to 2 at a) 30° C., b) 50° C., c) 70° C., respectively.

FIGS. 12*a-d* show Ag nanoparticles synthesized using PEI alone. a) a picture of the Ag nanoparticles and a 1000-fold diluted solution thereof b) a TEM image and a HRTEM image of the Ag nanoparticles; c) a XRD pattern of the Ag nanoparticles; d) a UV-vis spectrum of the Ag nanoparticles.

FIG. 13 shows an average particle size distribution of Ag nanoparticles synthesized using PEI alone.

FIG. 14 shows a XPS spectrum of Ag nanoparticles synthesized using PEI alone.

FIGS. 15*a-f* show TEM images and UV-vis spectrums of Ag nanoparticles synthesized using PEI alone according to reactions times of a) 30 minutes, b) 5 hours, and c) 10 hours.

FIG. 16 shows a TEM image of copper nanoparticles prepared in Example 6.

FIG. 17 shows a XRD pattern of copper nanoparticles prepared in Example 6.

FIG. 18 shows XRD patterns of copper nanoparticles where the upper black corresponds to a XRD pattern measured immediately after synthesis and the black corresponds to a XRD pattern measured after 3 months of the synthesis.

DETAILED DESCRIPTION OF THE PREFERRED EMBODIMENTS

Hereinafter, the present invention will be described in further detail with reference to examples. It is to be understood, however, that these examples are for illustrative purposes only and are not intended to limit the scope of the present invention.

<Preparation of Materials>

Branched polyethyleneimine (BPEI, MW=750,000, 50 wt % aqueous solution), silver nitrate ($AgNO_3$, purity ≥99%), copper (II) chloride ($CuCl_2$), and ascorbic acid ($C_6H_8O_6$, purity ≥99%) were purchased from Aldrich and used without further purification. Water was purified by an ion-exchange (DI water).

<Measurement Method>

BPEI-stabilized metal nanoparticles and their morphology were measured by transmission electron microscopy (TEM) having a JEM-2100F microscope operated at 200 kV and high-resolution transmission electron microscopy (HR-TEM).

In order to measure the distinctive functional groups of a product, fourier transform infrared (FTIR) spectroscopy was employed.

The structural features of the metal nanoparticles were measured using a Rigaku D-MAX/A diffractometer at 35 kV and 35 mA.

In order to measure the state of atoms of a final product, a thermo Scientific K-Alpha spectrometer was employed to obtain X-ray photoelectron spectroscopy (XPS) data.

An optical spectrum was measured using a Jasco UV-vis spectrophotometer within the scope from 250 to 800 nm.

Example 1: Preparation of Ag Nanoparticles Using BPEI and Ascorbic Acid

BPEI was dissolved in 4 ml of deionized water, and heated to 90° C. in an oil bath. The amount of BPEI used was equivalent to the weight ratio of BPEI:$AgNO_3$ of 2:1. 1 ml of 0.5 M silver nitrate aqueous solution was injected into the reaction system under the stirring speed of 850 rpm. 1.0 ml of 1 M ascorbic acid aqueous solution was added immediately to the reaction solution using a pipette, and the resultant was reacted at 90° C. for 8 minutes.

As a result, the reaction solution turned from a colorless solution to dark brown which indicates the formation of Ag nanoparticles. The thus-prepared colloidal dispersion was subject to centrifugation at 10,000 rpm for 10 minutes, and washed with DI water three times to remove the remaining residues. The thus-obtained pellet was dried overnight at 50° C. and then subjected to a quality analysis.

Ag nanoparticles were prepared with a high concentration of 500 mM by the above method (FIG. 1*a*), the average size of the Ag nanoparticles was 8.2±1.6 nm (FIGS. 1*b* and 1*c*), and the reaction time required to obtain the particles was about 8 minutes (FIG. 1*d*).

The XRD pattern for the thus-prepared Ag nanoparticles shows diffraction peaks at 38.1°, 44.3°, 64.7°, and 77.4°, representing the flat surfaces of (111), (200), (220), and (311) of the face-centered cube (fcc) structures of silver, respectively (FIG. 1*e*).

Meanwhile, the XPS spectrum of the thus-prepared Ag nanoparticles shows two distinctive peaks at 368.2 eV and 374.3 eV corresponding to the bonding energies of metal Ag $3d_{5/2}$ and Ag $3d_{3/2}$ core levels, thereby confirming the metal structures of the Ag nanoparticles (FIG. 1*f*).

Example 2: Preparation of Ag Nanoparticles Using Various Weight Ratios of BPEI:$AgNO_3$ Ag nanoparticles with a high concentration of 500 mM were prepared under the same conditions as Example 1, except that the weight ratios of BPEI:$AgNO_3$ used were 5:1, 7:1, and 11:1 by adjusting the amount of BPEI while fixing the concentration of silver nitrate.

The particle sizes of nanoparticles prepared were compared with the particle sizes of nanoparticles of Example 1, and the results are shown in FIGS. 2 to 4.

When the weight ratios of BPEI:$AgNO_3$ were used as 2:1, 5:1, 7:1, and 11:1, the average particles sizes were 8.2±1.6 nm, 15.8±3.5 nm, 24.2±5.9 nm, and 42.9±12.4 nm, respectively, indicating that as the weight ratio of BPEI:$AgNO_3$ increased, the average particle size of the Ag nanoparticles also increased (FIGS. 2 to 4).

Also, although the reaction time increased as the weight ratio of BPEI:$AgNO_3$ increased, the Ag nanoparticles were obtained for up to 50 minutes, and when the weight ratio of 2:1 was used, the reaction time was about 8 minutes, which was the shortest time taken to obtain Ag nanoparticles (FIGS. 3*a-d*).

Accordingly, various sizes of the Ag nanoparticles with a high concentration of 500 mM were prepared for up to 50 minutes by adjusting the weight ratio of BPEI:$AgNO_3$.

Example 3: Preparation of Ag Nanoparticles Using Various Volumes of Ascorbic Acid Ag nanoparticles with a high concentration of 500 mM were prepared under the same conditions as Example 1, except that the volumes of ascorbic acid aqueous solution used were 0.2 ml, 0.5 ml, and 0.7 ml, respectively.

The results are shown in FIGS. 5 to 7.

When the volumes of ascorbic acid used were 0.2 ml and 0.5 ml, the reaction time was 30 minutes, whereas when the volume was 0.7 ml, the reaction time was 20 minutes, completing the reactions for up to 30 minutes (FIGS. 5*a-c*). Further, when 1.0 ml of ascorbic acid was used, the reaction time was 8 minutes, which was the shortest time taken to obtain Ag nanoparticles (FIG. 1*d* and B line of FIG. 7).

Although the reaction time decreased as the volume of ascorbic acid increased, the Ag nanoparticles were obtained for up to 30 minutes in all reactions.

Also, the particle sizes of the Ag nanoparticles prepared using 0.2 ml, 0.5 ml, and 0.7 ml of ascorbic acid were similar to be about 15 nm (FIGS. 6*a-f*), whereas the particle size of the Ag particles prepared using 1.0 ml of ascorbic acid was about 8 nm (FIG. 1*c* and A line of FIG. 7).

Accordingly, the Ag nanoparticles were obtained with a high concentration of 500 mM for up to 30 minutes while controlling the particle size of the Ag nanoparticles by adjusting the volumes of ascorbic acid.

Example 4: Preparation of Ag Nanoparticles Using Different $AgNO_3$ Concentrations Ag nanoparticles with a high concentration of 500 mM were prepared under the same conditions as Example 1, except that the concentrations of $AgNO_3$ were 0.2 M, 0.7 M, 0.8 M, and 1.0 M.

The results are shown in FIGS. 8, 9, and 10.

The reaction times corresponding to $AgNO_3$ concentrations of 0.2 M, 0.7 M, 0.8 M, and 1.0 M were 18 minutes, 6 minutes, 4 minutes, and 2 minutes, respectively (FIGS. 8*a*, 8*b*, 8*c*, and 8*d*, respectively), indicating that the reaction time decreases as the concentration of $AgNO_3$ increases.

When the concentration of $AgNO_3$ was 0.2 M, the particle size of the Ag nanoparticles was 47.2±13.1 nm, which is considered relatively big and the deviation was also large, whereas when $AgNO_3$ concentrations of 0.7 M, 0.8 M, and 1.0 M were used, the particle size reduced to 16.9±4.3 nm, 25.1±8.5 nm, and 28.4±10.5 nm, respectively, indicating a uniform size distribution (FIGS. 9 and 10).

Example 5: Preparation of Ag Nanoparticles Using Different Reaction Temperatures Ag nanoparticles with a high concentration of 500 mM were prepared under the same conditions as Example 1, except that the reaction temperatures were 30° C., 50° C., and 70° C.

The TEM images and UV-vis spectrum data of the prepared particles are shown in FIGS. 11*a-d*.

The particle size of the nanoparticles prepared at 30° C. and 50° C. exceeded 100 nm showing undesirable for the size of nanoparticles. In contrast, when the temperature was at 70° C., the particle size decreased, however, it did not exhibit a uniform distribution (FIGS. 11*a-d*). Accordingly, it was confirmed that the reaction temperature of 90° C. used in Example 1 was the optimal temperature for the preparation of Ag nanoparticles with uniform size.

Comparative Example 1: Preparation of Ag Nanoparticles Using PEI Alone 0.169 g of BPEI (MW=750,000) was dissolved in 4 ml of deionized water, and heated to 50° C. while stirring. Meanwhile, 1 ml of 1 M $AgNO_3$ aqueous solution was added thereto using a micropipette (the total volume of the solution was 5 ml, and the weight ratio of BPEI/$AgNO_3$ was 0.5). The pH of the solution was 10. The resulting mixture was magnetically stirred for 10 hours, heated to 50° C., and cooled to room temperature. After adding $AgNO_3$ to the aqueous solution of BPEI, the color of the solution turned from bright yellow to dark brown, indicating the formation of colloid Ag nanoparticles. The thus-prepared colloidal dispersion was subjected to centrifugation for 30 minutes at 9,000 rpm. The centrifugation was repeated to obtain a final product, and the final product was washed three times with water to remove excess BPEI. The Ag nanoparticles were dispersed in water again.

Ag nanoparticles of 200 mM were prepared using the above method (FIG. 12*a*), and the average particle size of the Ag nanoparticles was 8.0±0.9 nm (FIGS. 12*b* and 13), indicating a monocrystal or a pair structures as observed in TEM (HRTEM) (FIG. 12*b* inset).

The XRD pattern for the Ag nanoparticles prepared in Comparative Example 1 shows diffraction peaks at 38.1°, 44.3°, 64.7°, 77.4°, and 81.6°, representing the flat surfaces of (111), (200), (220), (311), and (222) of the face-centered cube (fcc) structures of silver, respectively (FIG. 12*c*, Fm3m, a=4.086 A, Joint Committee on Powder Diffraction Standards (JCPDS) file NO. 04-0783).

Also, the XPS spectrum shows two distinctive peaks at 368.2 eV and 374.3 eV corresponding to the bonding energies of metal Ag $3d_{5/2}$ and Ag $3d_{3/2}$ core levels, thereby confirming the metal structure of Ag nanoparticles (FIG. 14).

The UV-vis extinction spectrum obtained from the aqueous dispersion of Ag nanoparticles show a strong plasmon resonance peak at about 408 nm, and it still shows a strong peak at 408 nm without any red shift or peak broadening even when the aqueous dispersion of the Ag nanoparticles were stored at room temperature for 40 days, showing a stabilization of nanoparticles without a size increase or an aggregation (FIG. 12*d*).

The reaction time of the Ag nanoparticles was measured from the start of the reaction by TEM images and UV-vis spectrum according to the time. As shown in FIGS. 15*a-f*, the nanoparticles of uniform size were synthesized after 10 hours from the start of the reaction.

Example 6: Preparation of Copper Nanoparticles Using BPEI and Ascorbic Acid 0.2 g of BPEI was dissolved in 2 ml of deionized water, added with 0.1 ml of 1 M copper(II) chloride ($CuCl_2$), and heated to 80° C. in an oil bath (the weight ratio of BPEI: $CuCl_2$=15.38). After 10 minutes, 3.0 ml of 1 M aqueous ascorbic acid solution was added to the reaction solution using a pipette, and stirred at 80° C. for 3 hours. The reaction solution was transferred to a 50 ml plastic tube, and 30 ml of acetone was added thereto to prepare a colloidal dispersion. The thus-prepared colloidal dispersion was subject to centrifugation for 30 minutes at 9,000 rpm. The supernatant was removed and the precipitate was re-dispersed in 5 ml of deionized water. The resulting precipitate was washed with DI water three times to remove the remaining residues, and the thus-obtained pellet was dried over night at 50° C.

Thus, copper nanoparticles with a high concentration of 120 mM were prepared by the above method with the average particle size of 5 nm (FIG. 16), and the XRD patterns exhibited diffraction peaks at 43.408°, 50.537°, and 74.173° (FIG. 17).

Experimental Example 1: A Long-Term Stability Test of the Metal Nanoparticles

The copper nanoparticles synthesized with a high concentration of 120 mM, prepared in Example 6, was stored for 90 days to analyze XRD patterns. As shown in FIG. 18, the XRD pattern (upper black pattern) measured at the time of synthesis was consistent with the XRD pattern (black pattern) measured after 90 days from the synthesis.

Accordingly, the copper nanoparticles prepared by the method in Example 6 maintained stable crystal structures even after 90 days, confirming the long-term stability.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A method for preparing metal nanoparticles by a reaction of a metal precursor with polyethylenimine and one or more reducing agent selected from the group consisting of ascorbic acid, potassium hydroxide (KOH), hydrazine ($N_2H_4$), sodium hydrophosphate, glucose, tannic acid, dimethylformamide, tetrabutylammonium borohydride, sodium borohydride ($NaBH_4$) and lithium borohydride ($LiBH_4$) in an aqueous solution, wherein the average particle size of the metal nanoparticles is 5 to 47 nm, the metal is silver (Ag) or copper (Cu), and the reaction is performed at a temperature from 70° C. to 100° C., wherein the metal precursor comprises copper (II) chloride ($CuCl_2$) or silver nitrate ($AgNO_3$).

2. The method of claim 1, wherein a weight ratio of polyethylenimine to metal precursor in an aqueous solution is from 1:1 to 20:1.

3. The method of claim 1, wherein the polyethylenimine is a branched polyethylenimine (BPEI).

4. The method of claim 3, wherein the branched polyethylenimine is represented by Formula 1 below:

[Formula 1]

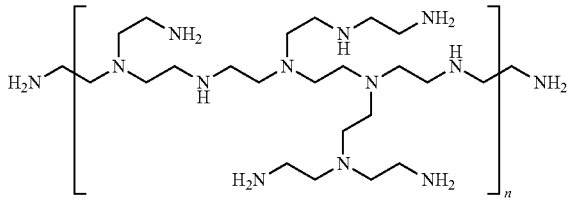

wherein n is integer such that the branched polyethylenimine has a molecular weight from 20,000 to 1,000,000.

5. The method of claim 1, wherein the reaction is performed by adding an aqueous solution of silver nitrate as a metal precursor to an aqueous solution of a branched polyethylenimine, stirring the resulting reaction solution, and then adding an aqueous solution of ascorbic acid as a reducing agent to the reaction solution.

6. The method of claim 5, wherein a weight ratio of polyethylenimine to silver nitrate is from 2:1 to 15:1.

7. The method of claim 5 wherein the reaction is performed at a temperature from 70° C. to 100° C. for from 2 minutes to 1 hour.

8. The method of claim 5, wherein the reaction is performed at about 90° C. for up to 10 minutes.

9. The method of claim 5, wherein the concentration of the aqueous solution of silver nitrate is from 0.01 M to 1.5 M.

10. The method of claim 1, wherein the reaction is performed by adding an aqueous solution of copper (II) chloride as a metal precursor to an aqueous solution of a branched polyethylenimine, stirring the resulting reaction solution, and then adding an aqueous solution of ascorbic acid as a reducing agent to the reaction solution.

11. The method of claim 10, wherein the reaction is performed at a temperature from 70° C. to 100° C. for 1 to 4 hours.

12. The method of claim 10, wherein the reaction is performed at about 80° C. for up to 3 hours.

* * * * *